United States Patent [19]

Camerino

[11] Patent Number: 5,064,095

[45] Date of Patent: Nov. 12, 1991

[54] WATER CANNON APPARATUS

[76] Inventor: Michael J. Camerino, 11242 Trailside Ct., San Diego, Calif. 92127

[21] Appl. No.: 493,689

[22] Filed: Mar. 15, 1990

[51] Int. Cl.[5] ..... B65D 37/00

[52] U.S. Cl. ..... 222/99; 222/212; 222/386.5

[58] Field of Search ..... 222/79, 99, 100, 212, 222/215, 92, 386.5

[56] References Cited

U.S. PATENT DOCUMENTS

| | | | |
|---|---|---|---|
| 1,608,055 | 11/1926 | Brownler | 222/100 |
| 3,197,070 | 7/1965 | Pearlet et al. | 222/79 |
| 3,848,808 | 11/1974 | Fetty et al. | 222/183 |
| 4,257,460 | 3/1981 | Paranay et al. | 222/79 |
| 4,597,527 | 7/1986 | Sands | 222/330 |
| 4,615,488 | 10/1986 | Sands | 239/391 |
| 4,733,799 | 3/1988 | Wiseur | 222/79 |

FOREIGN PATENT DOCUMENTS

| | | | |
|---|---|---|---|
| 503597 | 12/1954 | Italy | 222/99 |

*Primary Examiner*—Michael S. Huppert
*Assistant Examiner*—Shari Wunsch
*Attorney, Agent, or Firm*—Leon Gilden

[57] ABSTRACT

An apparatus including an elongate, cylindrical elastomeric magazine body secured to a forward rigid, cylindrical shaft member, wherein the shaft member includes a forwardly threaded end threadedly mounted to an internally threaded conical valve, wherein the conical valve includes a forward nozzle aperture formed therewithin. The rearward end of the elastomeric body is knotted and the body is fastened to the forward cylindrical portion, wherein the conical forward end is received within a securement sleeve which in turn is mounted to a connector to mount the connector to a source of water to effect filling of the magazine housing to permit selective discharge thereof.

1 Claim, 4 Drawing Sheets

PRIOR ART

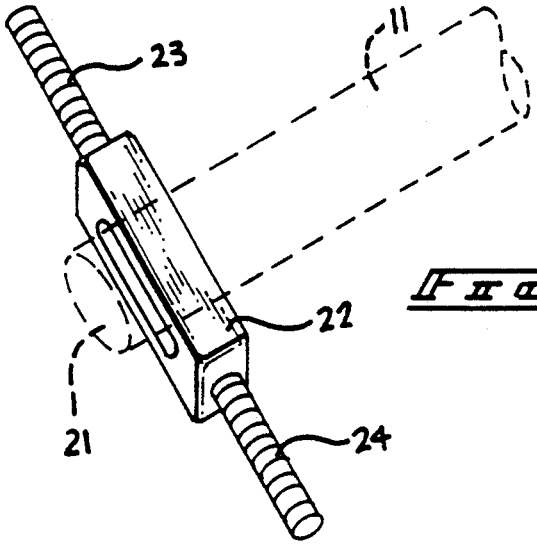
FIG 7
FIG 8
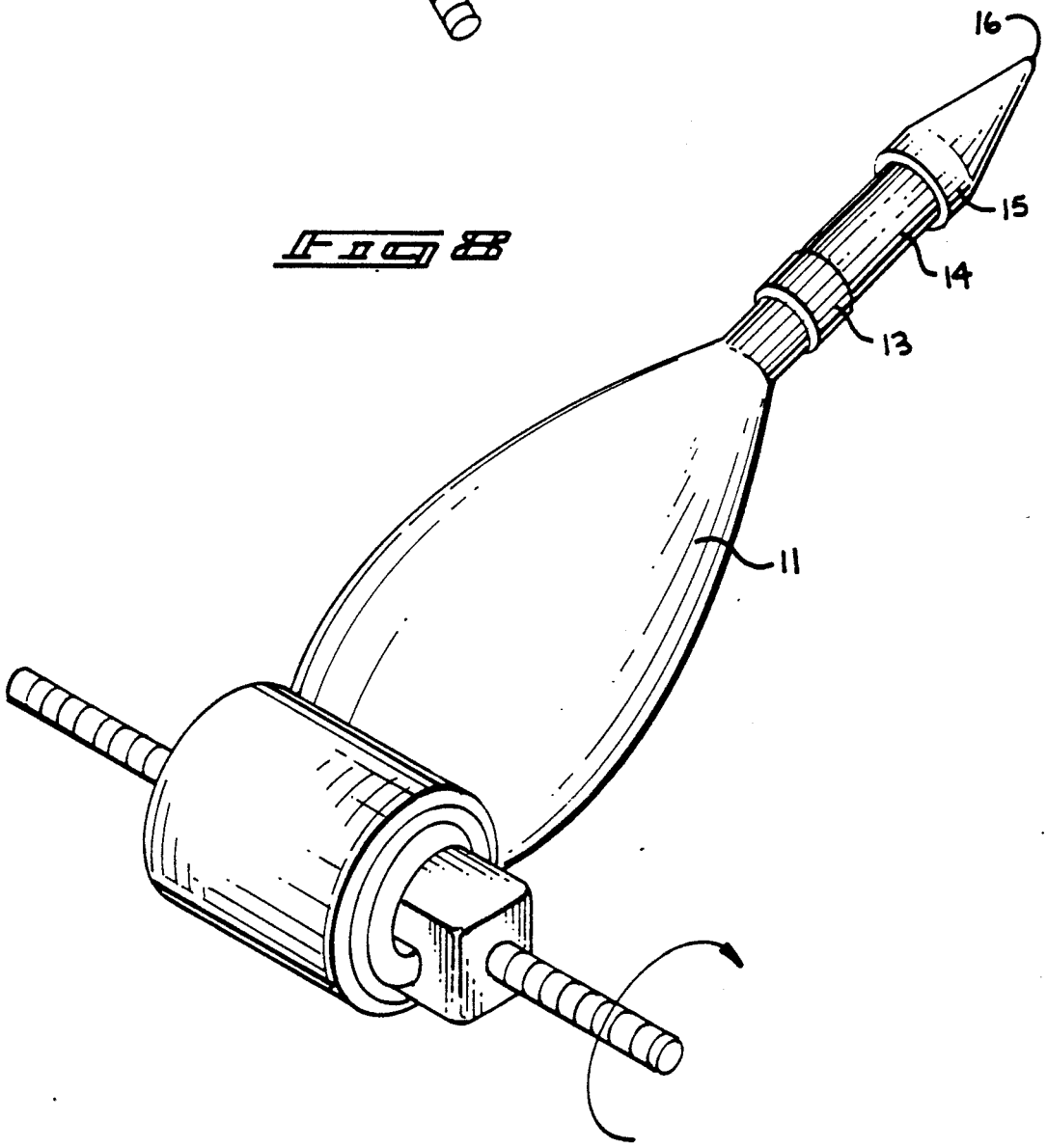

WATER CANNON APPARATUS

BACKGROUND OF THE INVENTION

1. Field of the Invention

The field of invention relates to water cannons, and more particularly pertains to a new and improved water cannon apparatus wherein the same provides a novelty water cannon type toy for amusement and interest by individuals.

2. Description of the Prior Art

The prior art has utilized various weaponry configured devices for use as water cannons. Inasmuch as a degree of reluctance is present among various individuals in utilizing weaponry configured water cannons, the instant invention provides a psychologically accommodating and pleasing configuration capable of a wider range of acceptance by individuals for amusement and use thereof. Examples of prior art water cannons include U.S. Pat. No. 4,257,460 to Paranay wherein an elastomeric magazine is mounted to a forward nozzle utilizing a trigger operative valve to effect discharge selectively through the nozzle.

U.S. Pat. No. 4,733,799 to Wiskur provides a water type toy gun including an elongate cylindrical body containing a plunger directed rearwardly thereof, wherein the plunger is positionable against an individual's shoulder to direct fluid through a forward nozzle mounted at a forward end of the tube.

U.S. Pat. No. 4,597,527 to Sands provides a toy type water gun wherein the gun is operative by a plunger piston rod removable within a water storage cylinder mounted within the gun to direct fluid through a forward aperture of the gun.

U.S. Pat. No. 4,615,488 to Sands provides a cylindrical nozzle having several relatively rotatable members to direct streams in different directions in response to a manual rotation, wherein the nozzle is positionable in the water gun to provide various modes of operation providing various directions of discharge of water.

U.S. Pat. No. 3,197,070 to Pearl, et al., provides a water gun device simulating a flame thrower in configuration with a hollow chamber and associated plunger to direct fluid from the toy.

As such, it may be appreciated that there continues to be a need for a new and improved water cannon apparatus wherein the same addresses both the problems of ease of use, as well as effectiveness in construction and operation and in this respect, the present invention substantially fulfills this need.

SUMMARY OF THE INVENTION

In view of the foregoing disadvantages inherent in the known types of water cannon apparatus now present in the prior art, the present invention provides a water cannon apparatus wherein the same includes an organization arranged for compact storage during periods of non-use and easily and readily arranged to direct a stream of fluid therefrom as a novelty toy cannon apparatus. As such, the general purpose of the present invention, which will be described subsequently in greater detail, is to provide a new and improved water cannon apparatus which has all the advantages of the prior art water cannon apparatus and none of the disadvantages.

To attain this, the present invention provides an apparatus including an elongate, cylindrical elastomeric magazine body secured to a forward rigid, cylindrical shaft member, wherein the shaft member includes a forwardly threaded end threadedly mounted to an internally theaded conical valve, wherein the conical valve includes a forward nozzle aperture formed therewithin. The rearward end of the elastomeric body is knotted and the body is fastened to the forward cylindrical portion, wherein the conical forward end is received within a securement sleeve which in turn is mounted to a connector to mount the connector to a source of water to effect filling of the magazine housing to permit selective discharge thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water cannon apparatus which has all the advantages of the prior art water cannon apparatus and none of the disadvantages.

It is another object of the present invention to provide a new and improved water cannon apparatus which may be easily and efficiently manufactured and marketed.

It is a further object of the present invention to provide a new and improved water cannon apparatus which is of a durable and reliable construction.

An even further object of the present invention is to provide a new and improved water cannon apparatus which is susceptible of a low cost of manufacture with regard to both materials and labor, and which accordingly is then susceptible of low prices of sale to the consuming public, thereby making such water cannon apparatus economically available to the buying public.

Still yet another object of the present invention is to provide a new and improved water cannon apparatus which provides in the apparatuses and methods of the prior art some of the advantages thereof, while simultaneously overcoming some of the disadvantages normally associated therewith.

Still another object of the present invention is to provide a new and improved water cannon apparatus wherein the same is of a convenient and readily transported configuration to permit ease of manipulation and selective discharge of fluid therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric view of the instant invention illustrating a discharge tool utilized by the instant invention.

FIG. 8 is an isometric illustration of the discharge tool in operative association with the magazine of the instant invention.

DESCRIPTION OF THE PREFERRED EMBODIMENT

Figure 1:
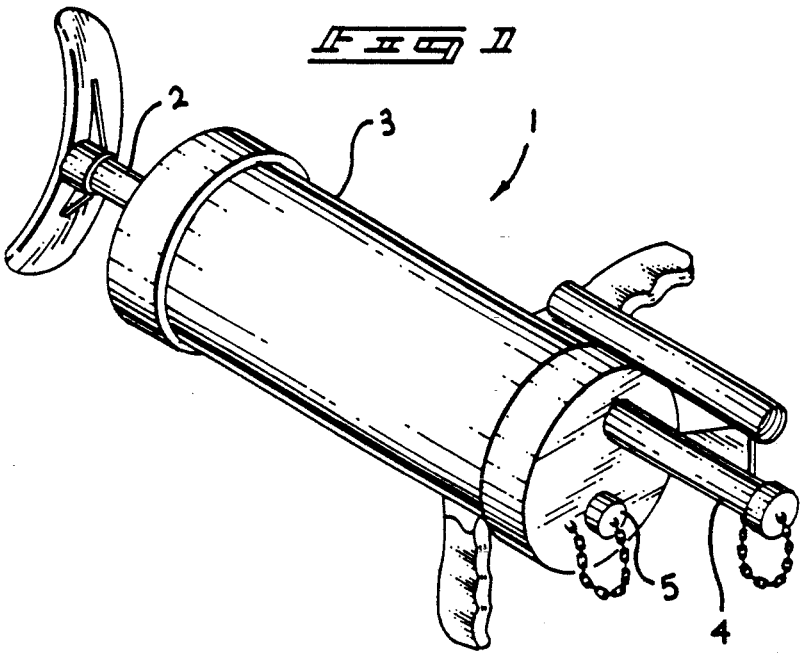
FIG. 1 is an isometric illustration of a prior art water cannon apparatus.

With reference now to the drawings, and in particular to FIGS. 1 to 8 thereof, a new and improved water cannon apparatus embodying the principles and concepts of the present invention and generally designated by the reference numeral 10 will be described.

Figure 2:
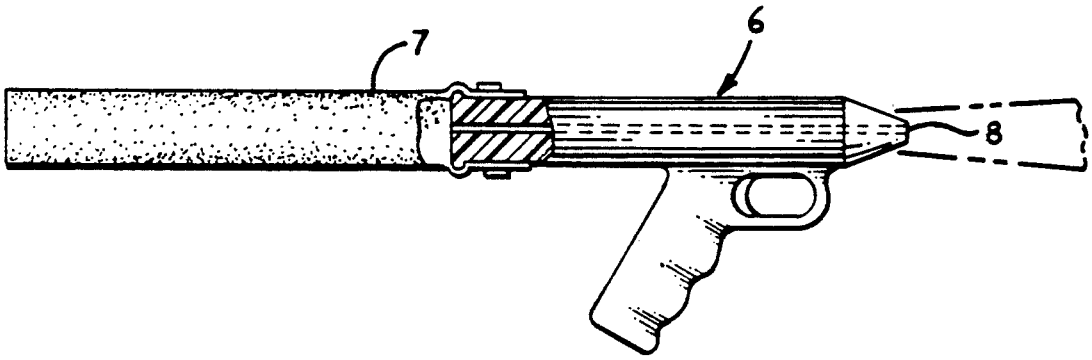
PRIOR ART FIG 2
FIG. 2 is an orthographic side view of a further prior art water cannon apparatus.
Figure 3:
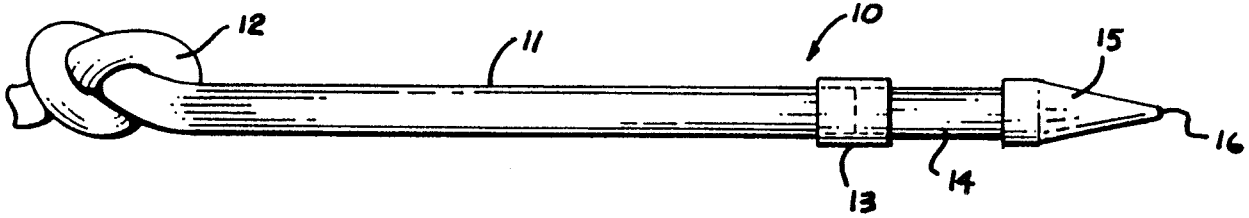
FIG. 3 is an orthographic side view of the instant invention.
Figure 4:
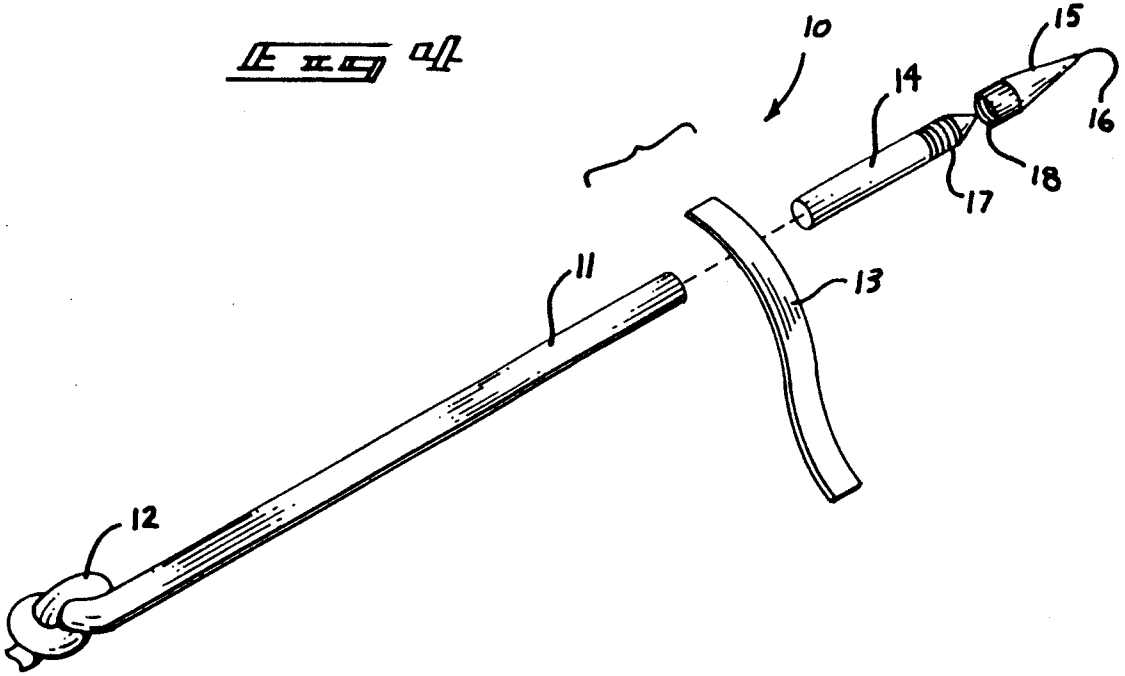
FIG. 4 is an isometric exploded illustration of the instant invention.

FIG. 1 illustrates a prior art water cannon apparatus 1 utilizing a piston 2 directed into a cylinder 3 to discharge water through a forward nozzle 4. A fill opening 5 is selectively available to effect filling of the rigid magazine 3. FIG. 2 illustrates a further prior art water cannon apparatus 6 formed with a forward nozzle 8, with a rearwardly oriented flexible magazine 7 that is filled and expands to provide storage for water to be selectively directed through the nozzle 8 by use of the trigger underlying the main housing, as illustrated.

More specifically, the water cannon apparatus 10 of the instant invention essentially comprises an elongate, elastomeric magazine body 11 defined as a flexible cylindrical expandable membrane. The body is provided with a knotted rearward end 12 to effect closure of the rearward end of the body 11, with a flexible coupling member 13 securable about a forward end of the body 11 to secure in a coaxially aligned relationship a rigid forward cylindrical handle end 14. The handle end 14 includes an externally threaded forward end portion 17 to threadedly receive a conical valve 15 thereon. The valve 15 is formed with a nozzle forward end opening 16. The forward end portion 17 further includes a slotted conical projection **17*a* to cooperate with the forward end opening 16 to permit selective fluid coupling of the magazine body 11 with the opening 16. The conical valve 15 includes an internally threaded cylindrical base 18 to threadedly mount the conical valve 15 to the threaded forward end portion 17**.

Figure 5:
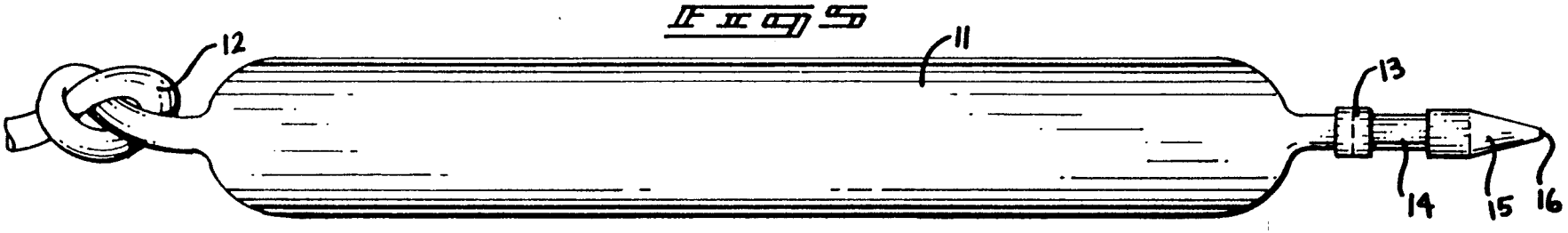
FIG. 5 is an orthographic side view of the instant invention illustrating the magazine in a filled condition.
Figure 6:
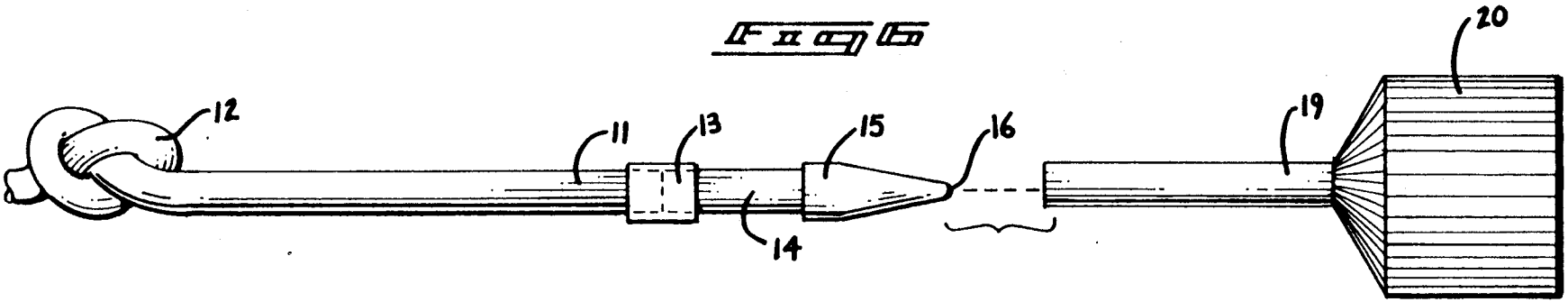
FIG. 6 is an orthographic side view illustrating the invention in association with a water coupler to effect filling of the associated magazine of the instant invention.

FIG. 6 illustrates the use of a flexible securement sleeve 19 defined by an internal diameter substantially equal to the external diameter of the cylindrical base 18 to provide a water-tight fit of the base 18 interiorly of the sleeve 19. The sleeve 19 is in fluid communication with a hose connector coupling member 20 for securement of the coupling member to a fluid source to fill the magazine body 11 and expand the magazine body in a manner as illustrated in FIG. 5. Subsequently upon rotation of the conical valve 15 to a desired radial rotation, the opening 16 is exposed relative to the slotted conical projection **17*a* to effect fluid flow at a selective volume and pressure through the opening 16**.

The invention further includes removal of the knotted rearward end 16 to provide an opened rearward end portion 21 to receive a block 22. Subsequently, the knotted rearward end portion 21 may be applied securing the slotted and elongate longitudinally aligned block 22 overlying the magazine body adjacent the knotted rearward end. The elongate slotted block receives the magazine body 11 within a medially aligned slot within the block 22 and by rotation of the longitudinally aligned first and second respective handles 23 and 24, manual rotation of the slotted block 22 is available to increase pressure directed from the magazine body into the conical valve and subsequently effect fluid flow in terms of volume and velocity through the nozzle forward opening 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A water cannon apparatus, comprising in combination, an elastomeric magazine body defined by a generally cylindrical configuration, the body including a body rearward end and a body forward end, the body rearward end including a closure member, and the body forward end including a flexible coupling, and a rigid, elongate cylindrical housing coaxially aligned relative to the elastomeric body, the cylindrical housing including a housing rearward end secured to the coupling and the body forward end, and the housing forward end including a valve member secured thereon, the valve member rotatably mounted to the body forward end, and the valve including a nozzle, the rotative mounting of the valve effects selective fluid flow through the nozzle, and wherein the cylindrical housing includes a slotted conical projection, the slotted conical projection mounted to the housing forward end and in operative association with the nozzle to vary fluid flow through the nozzle upon rotation of the valve relative to the housing forward end, and wherein the housing forward end includes an externally threaded portion, and the valve includes an internally threaded portion cooperative with the externally threaded portion, and wherein the closure member includes a knot, and further including a flexible securement sleeve, the flexible securement sleeve defined by a predetermined internal diameter substantially equal to an external predetermined diameter defined by the valve for effecting fluid-tight securement of the valve interiorly of the securement sleeve, and the securement sleeve including an internally threaded coupling member to secure the coupling member to a source of pressurized fluid, and further including a slotted elongate block, the slotted elongate block including a longitudinally aligned through-extending enclosed slot formed medially and completely through the block, the slot receiving the body adjacent the knot, and the body mounted for rotative winding of the flexible body externally thereof, and wherein the elongate block is defined by a longitudinal length greater than the predetermined diameter, and a body diameter defined by the elastomeric body, and wherein the elongate block includes a first and second handle, each first and second handle orthogonally and integrally mounted to an opposed end portion of the elongate block, and wherein the first and second handle are longitudinally aligned relative to one another to enhance manual rotation of the elongate block about the body.

* * * * *